US005207796A

United States Patent [19]

Crotti et al.

[11] Patent Number: 5,207,796

[45] Date of Patent: May 4, 1993

[54] ELECTRONIC TYPEWRITER

[75] Inventors: Alessandro Crotti, Strambino; Daniele Mazzini, Caluso, both of Italy

[73] Assignee: Ing. C. Olivetti & C., S.p.A., Ivrea, Italy

[21] Appl. No.: 841,327

[22] Filed: Feb. 25, 1992

[30] Foreign Application Priority Data

Feb. 25, 1991 [IT] Italy ..... T091A000126

[51] Int. Cl.[5] ..... B41J 23/34

[52] U.S. Cl. ..... 400/185; 400/568; 400/569

[58] Field of Search ..... 400/185, 186, 283, 187, 400/568, 569

[56] References Cited

U.S. PATENT DOCUMENTS

| | | | |
|---|---|---|---|
| 4,449,835 | 8/1984 | Arai | 400/185 |
| 4,637,744 | 1/1987 | Valle et al. | 400/185 |
| 4,697,941 | 10/1987 | Takenoya | 400/185 |
| 4,787,761 | 11/1988 | Tezuka et al. | 400/187 |
| 5,106,216 | 4/1992 | Kim | 400/185 |

*Primary Examiner*—Eugene H. Eickholt
*Attorney, Agent, or Firm*—Banner, Birch, McKie & Beckett

[57] ABSTRACT

An electronic typewriter (11) has a line spacing device (29) for rotating a platen roller (16) and a transport device (28) for moving a printing carriage (19) in both directions. The line spacing and transport devices are driven from a single motor (32) via an intermediate gear (40) mounted on a shift member (35). The shift member (35) is displaceable between two operative positions for connecting a driveshaft (33) to the transport device (28) or to the line spacing device (29). A servomechanism (36) which is motorized by the shaft (33) displaces the shift member (35) between the two positions by means of a shift electromagnet (81) which actuates a lever (79) to lock the gear (40) by means of teeth (88) on a slide member (43). Positioning means (44) hold the shift member (35) in each of the two operative positions, and an electronic control means (22) controls the motor (32) and the electromagnet (81). The system is of low cost, and is simple, functional and reliable.

33 Claims, 7 Drawing Sheets

ELECTRONIC TYPEWRITER

BACKGROUND OF THE INVENTION

The present invention concerns an electronic typewriter comprising an electric motor having a driveshaft which is rotatable in both directions, a first function device, a second function device, a shift member which is displaceable from one of two operative positions to the other to connect the first or the second function device to the driveshaft, a shift electromagnet for control of said shift member and an electronic control means for controlling the electric motor and the shift electromagnet.

French patent application No. FR-A-2 439 676 discloses a typewriter of that type in which the two devices comprise a line spacing device for rotating the platen roller and a transport device for moving a printing carriage in both directions in front of the platen roller. The electric motor rotates a driveshaft to which is fixed a single central drive wheel for the two devices, having two series of face teeth positioned on opposite sides. The line spacing and transport devices are motorized by means of two corresponding splined sleeves which are rotatable on the driveshaft, on the opposite side with respect to the drive wheel. The shift member comprises two wheels with face teeth, which are fixed in respect of rotation and which are axially slidable with respect to the two sleeves and which are capable of engaging with their face teeth with the teeth of the drive wheel. A power electromagnet, by means of lever systems, holds one of the two lateral wheels in engagement with the drive wheel and the other spaced from said wheel. An electronic control means controls the electromagnet for selection of one or other of the line spacing and transport devices, and controls the electric motor for selective rotation of the drive wheel and actuation of the selected device. That shift mechanism is rather complicated and expensive by virtue of the cost of the power electromagnet and the associated electronic control devices which are required for displacement of the wheels which can be coupled to the common tooth wheel.

SUMMARY OF THE INVENTION

The technical problem of the present invention is therefore that of providing an electronic typewriter in which two different devices can be actuated by a single motor and by means of a shift member which is simple, reliable and of minimum cost.

An electronic typewriter embodying the invention has a servomechanism for displacing the shift member between two operative positions and activatable to be motorized by the driveshaft, an actuating element operated by the shift electromagnet for actuating the servomechanism, and positioning means for holding the shift member in each of the two operative positions. The electronic control means in turn selectively controls the electric motor for displacing the shift member from one of said operative positions to the other by means of said servomechanism.

BRIEF DESCRIPTION OF THE DRAWINGS

These and other features will be apparent from the following description of a preferred embodiment of the invention which is set forth by way of non-limiting example, with reference to the accompanying drawings in which.

DETAILED DESCRIPTION OF THE PREFERRED EMBODIMENT

Figure 1:
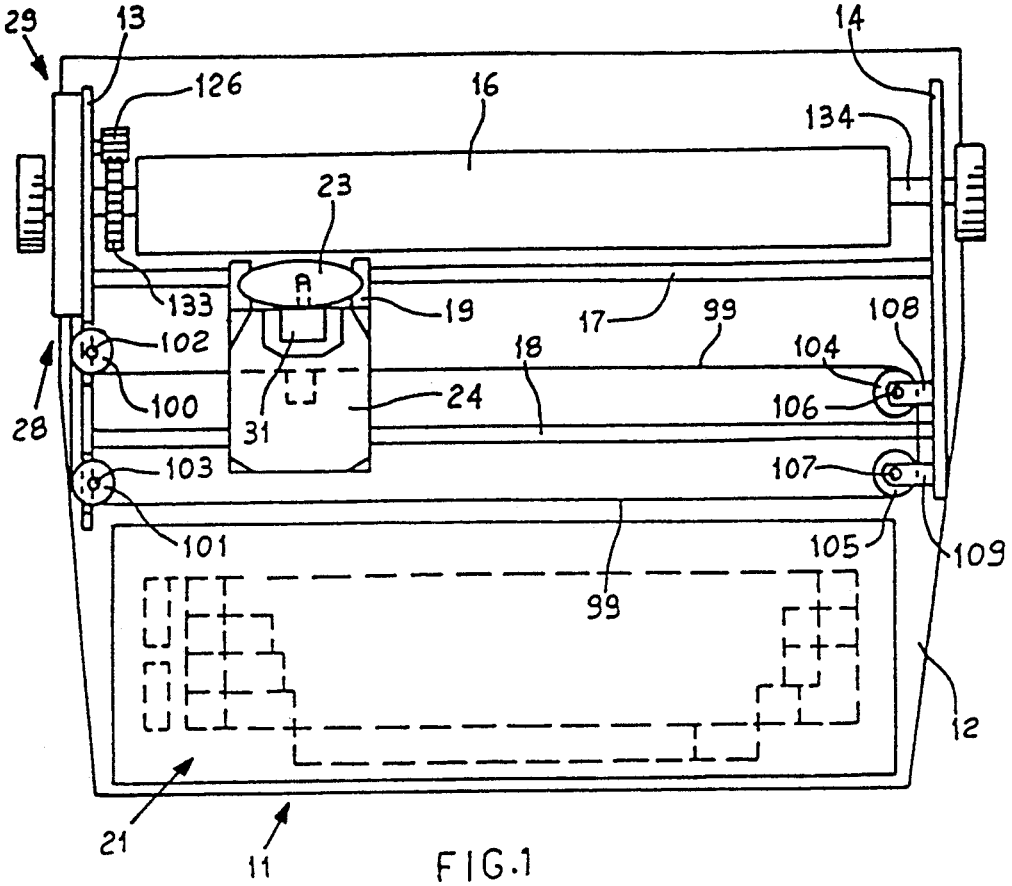
FIG. 1 is a diagrammatic plan view of an electronic typewriter embodying the invention.
Figure 10:
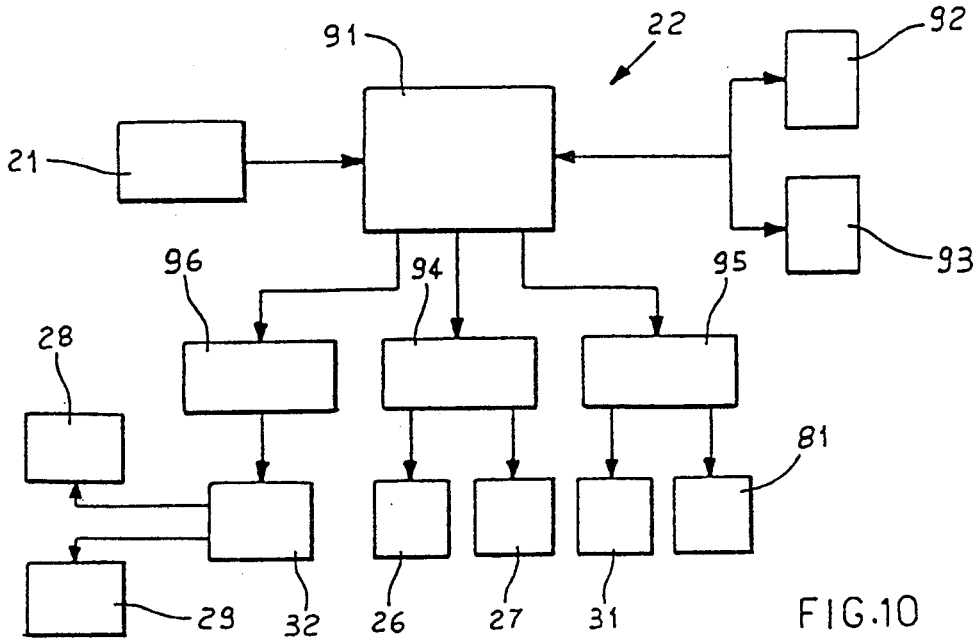
FIG. 10 is a logic block circuit diagram of a control and management unit of the machine shown in FIG. 1.

Referring to FIGS. 1, 2, 5, 6 and 10, an electronic typewriter is generally indicated by reference numeral 11 and comprises a base frame structure 12 having a left-hand support 13 and a right-hand support 14 of plastics material, which are vertical in use and which rotatably support a platen or typing roller 16. Two guides 17 and 18 which are parallel to the roller 16 are also supported by the supports 13 and 14 and slidably guide a printing carriage 19.

The machine 11 further comprises a keyboard 21, an electronic control means 22, a transport device 28 for moving the printing carriage 19 in both directions and a line spacing device 29 for rotating the platen roller 16. Mounted in turn on the carriage 19 are a printing member 23 of the character-carrying disc type, a cartridge 24 for a typing ribbon, a character selection device 26 for selecting the characters of the printing member 23, a ribbon feed mechanism 27 and a striker solenoid 31 for printing characters, all those being of known type and not described in detail herein.

Some of the main parts of the transport device 28 and the line spacing device 29 are supported by the left-hand support 13. Adjacent to those parts, also fixed on the left-hand support 13 is an electric stepping motor 32 having a driveshaft 33 on which is fixed a drive pinion 34. A shift member 35 is supported by the left-hand support 13 and is displaceable from one of two operative positions to the other to connect the drive pinion 34 to the transport device 28 or the line spacing device 29. A servomechanism 36 is provided for displacing the shift member 35 between the two operative positions by means of a suitable thrust member 37.

The shift member 35 comprises a slider 50 with a sleeve 38 and a gear member 40 having a shaft 39 rotatable in the sleeve 38 and always engaged with the drive pinion 34. The shift member 35 is displaceable in a shift direction which is substantially vertical in use due to the action of the drive pinion 34 on the gear member 40, as described hereinafter, from a first operative position in which the gear member 40 is engaged with a toothed wheel 41 of the transport device 28 to a second operative position in which the gear member 40 is engaged with a toothed wheel 42 of the line spacing device 29.

The thrust member 37 comprises a slide member 43 which is supported slidably by the slider 50 and which is displaceable from a rest position in which it co-operates with positioning means 44 for removably holding the shift member 35 either in the first or in the second operative position, to an operative state or selection position in which the shift member 35 is free from the means 44 to be positioned either in the first or in the second operative position with respect to the second or the first operative position respectively in which it was previously held. The slide member 43 is thus supported by the shift member 35 and is capable of movement from the rest position to the selection position and vice-versa with an alternating linear motion which in use is substantially horizontal and has a component perpendicular to the direction of movement of the shift member 35.

Figure 7:
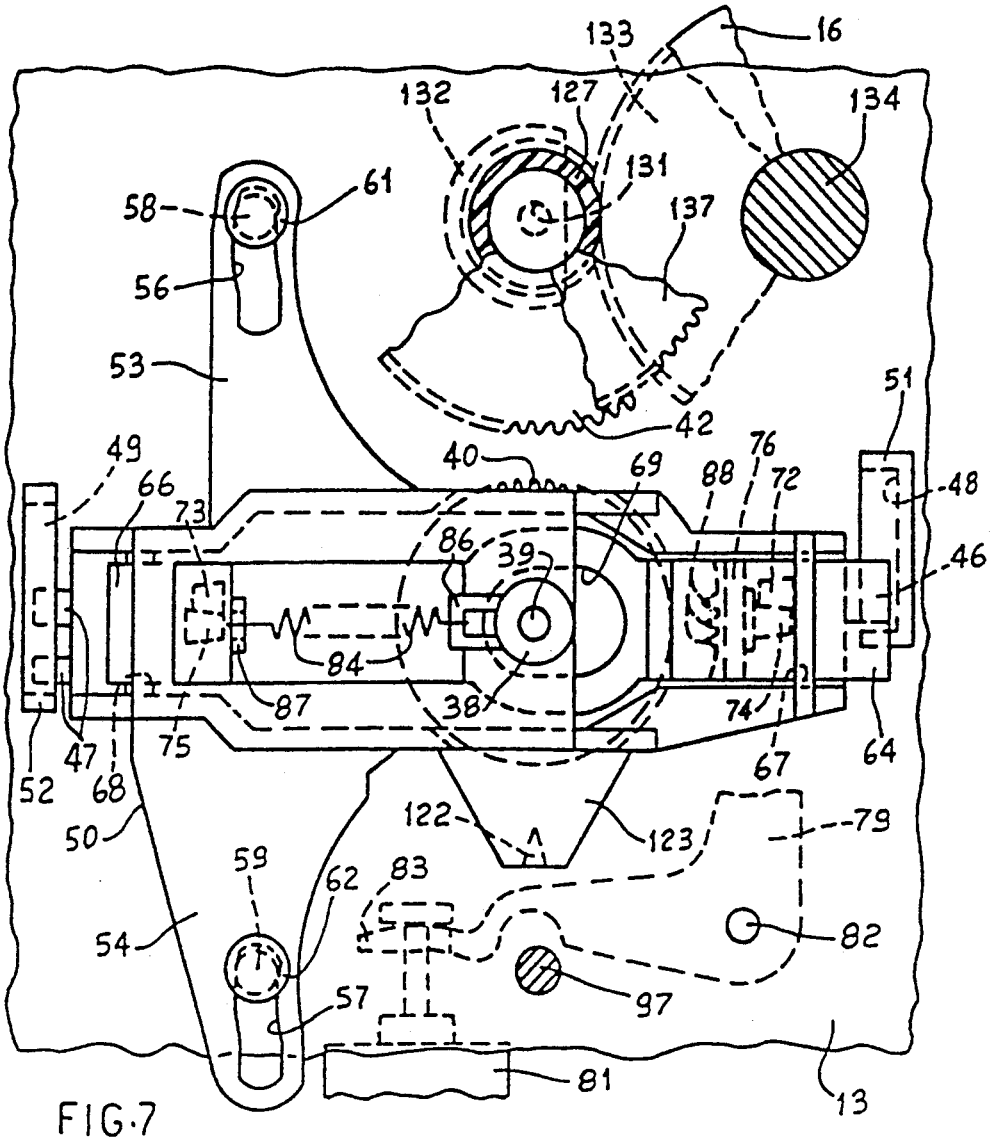
FIG. 7 is a partial rear view of some details in FIG. 2.
Figure 8:
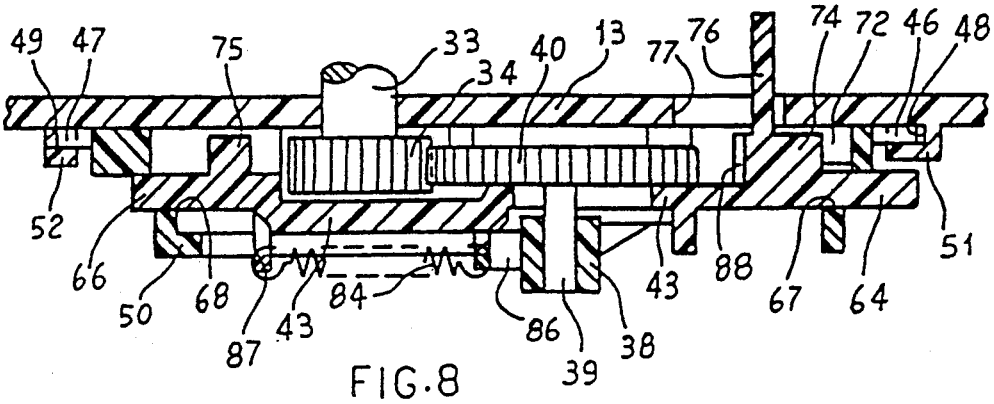
FIG. 8 is a partial side view in section of some details shown in FIG. 7.
Figure 9:
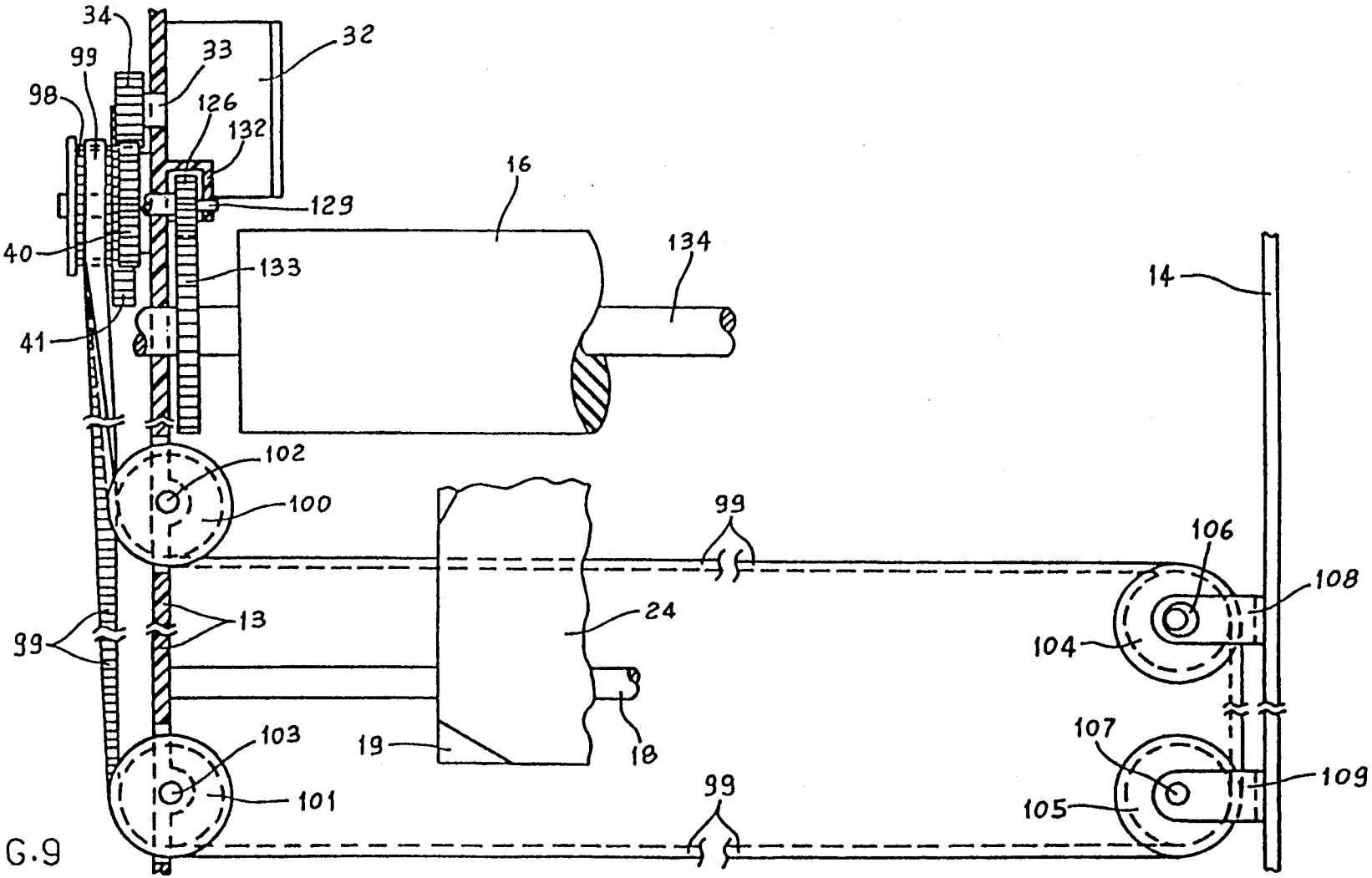
FIG. 9 is a partial plan view of some details shown in FIG. 1, on a different scale.

The slider 50 of the shift member 35 is in the form of a cross with a horizontal central body and two vertical arms 53 and 54. The slider 50 is connected to the left-hand support 13 in such a way as to move in a plane which in use is vertical. For that purpose, at its ends the central body comprises guide tongues 46 and 47 which are slidable in suitable grooves 48 and 49 provided in raised portions 51 and 52 projecting from the left-hand support 13 (see also FIGS. 7 and 8) and the two arms 53 and 54 in turn have slots 56 and 57 which are coupled to fixed pins 58 and 59 on the left-hand support 13. In its movement between the first and second operative positions the slider 50 is held parallel and adjacent to the left-hand support 13 by the effect of the raised portions 51 and 52 and heads 61 and 62 of the fixed pins 58 and 59.

The axes of the toothed wheels 41 and 42 are disposed in a geometrical plane which is vertical in use. The sleeve 38 is disposed in an intermediate portion of the slider 50 and the axis of the gear member 40 is coplanar with the axes of the wheels 41 and 42 in each of the operative positions of the slider 50. The slots 56 and 57 are in turn suitably shaped to be guided on the fixed pins 58 and 59 in such a way that, in its movement between the first and second operative positions, the slider 50 moves along a vertical path of movement which is so oriented that the gear member 40 is always held in engagement with the drive pinion 34 and engagement with the two gears 41 and 42 is facilitated.

The slide member 43 is disposed between the support 13 and the slider 50, being accommodated in a longitudinal groove 63 in the slider 50 which is directed towards the support 13, and it is guided with its two ends 64 and 66 by two seats 67 and 68 of the slider 50, in its alternating linear motion. The slide member 43 has a slot 69 through which passes the shaft 39 of the gear member 40, being of a size such as to accommodate the shaft 39 with play both when the slide member 43 is in the rest position and when it is in the selection position.

The positioning means 44 comprise first stop means 70 and second stop means 71 which are capable of selectively arresting the slider 50 in each of the two operative positions. The first stop means 70 and the second stop means 71 each comprise one or more stop surfaces 72 and 73 and one or more co-operating surfaces 74 and 75. In the construction described, which is non-limiting in that respect, there are two stop surfaces 72 and 73 and two co-operating surfaces 74 and 75. The stop surfaces 72 and 73 comprise two stops which are fixed in projecting relationship from the support 13. The co-operating surfaces 74 and 75 comprise two shoulders projecting upwardly from the plane of the slide member 43 and adjacent to the ends 64 and 66. The stops 72 and 73 and the shoulders 74 and 75 are in a wedge-shaped configuration having the two opposite sides of greater length converging towards each other and formed by inclined surfaces which define the stop surfaces and the co-operating surfaces of the first and second stop means. The two shoulders 74 and 75 are positioned with their inclined surfaces opposite to the inclined surfaces of the two stops 72 and 73 in such a way as to co-operate with each other when the slider 50 is in the first and in the second operative position respectively.

The slide member 43 comprises a tongue 76 which is fixed with respect to the shoulder 74 and which projects from the plane of the slide member 43 beyond the shoulder 74 to pass through an opening 77 in the left-hand support 13 and co-operate with an end 78 of an actuating element 79 which is operated by a shift electromagnet 81. The actuating element 79 comprises a bellcrank lever which is pivotally mounted on a pin 82 on the left-hand support 13, having an end 78 which co-operates with the tongue 76 and a second end 83 co-operable with the shift electromagnet 81 which is supported by the left-hand support 13.

The shift electromagnet 81 is controlled by the electronic control means 22 to move the slide member 43 from the rest position to the selection position. Resilient means 84 formed by a spring operatively disposed between a projection 86 on the slider 50 and a projection 87 projecting from the side opposite to the shoulder 75 of the slide member 43 are provided for returning the slide member 43 from the selection position to the rest position.

The thrust member 37 of the servomechanism 36 comprises a stop element 88 which is operated by the actuating element 79 to arrest the gear member 40 with respect to the slider 50 in the operative or selection state. The stop element 88 comprises one or more teeth, in the specific construction three teeth, which are carried by the slide member 43 and which are fixed with respect to the tongue 76 but positioned opposite to the shoulder 74, being capable of engaging with the gear member 40 when the slide member 43 is in the selection position, as can be clearly seen from FIG. 3, to prevent rotary movement of the gear member 40 and convert the rotary movement of the drive pinion 34 into displacement of the slider 50.

Figure 2:
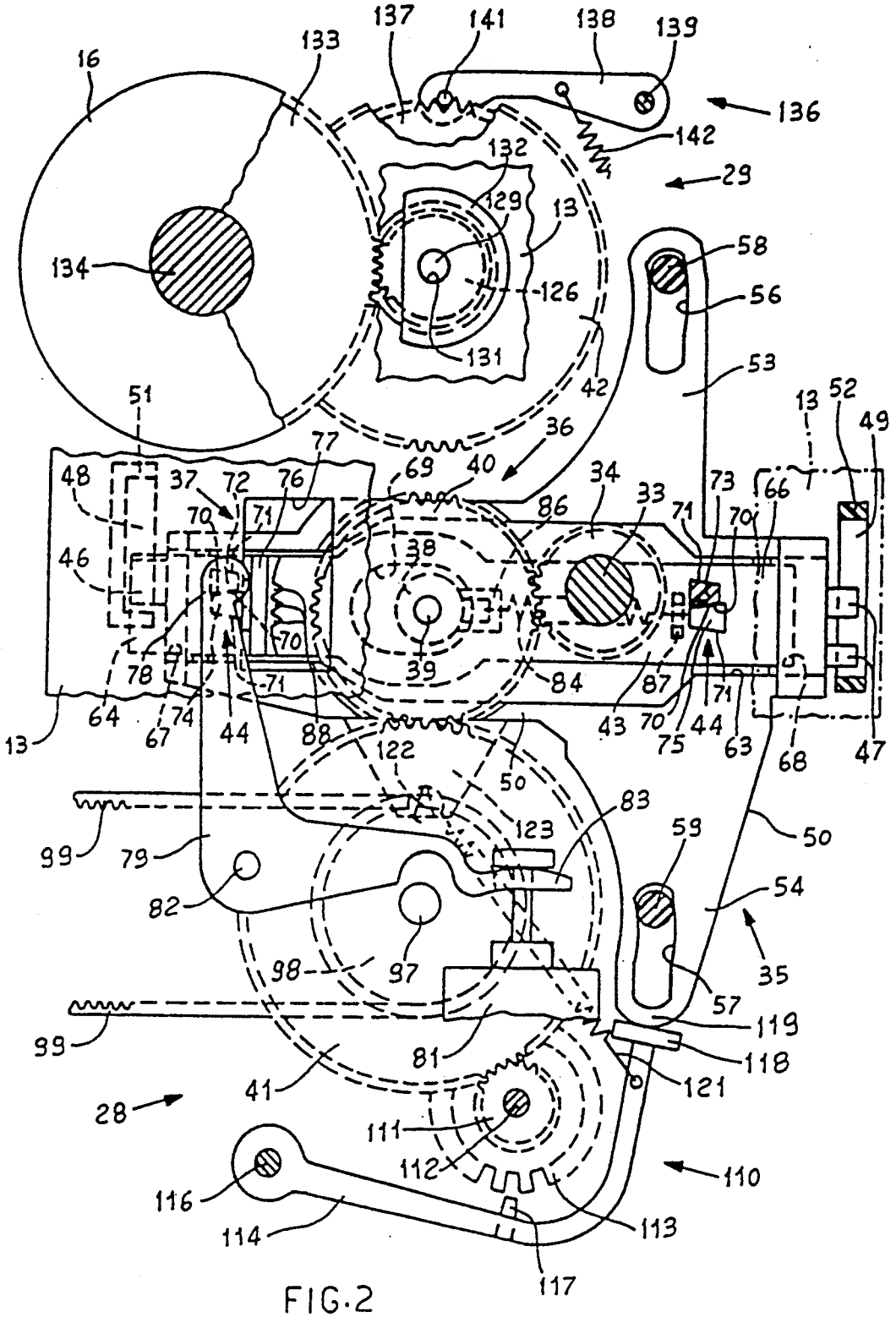
FIG. 2 is a partial front view of some details of the machine shown in FIG. 1 in first working position, on a different scale.
Figure 4:
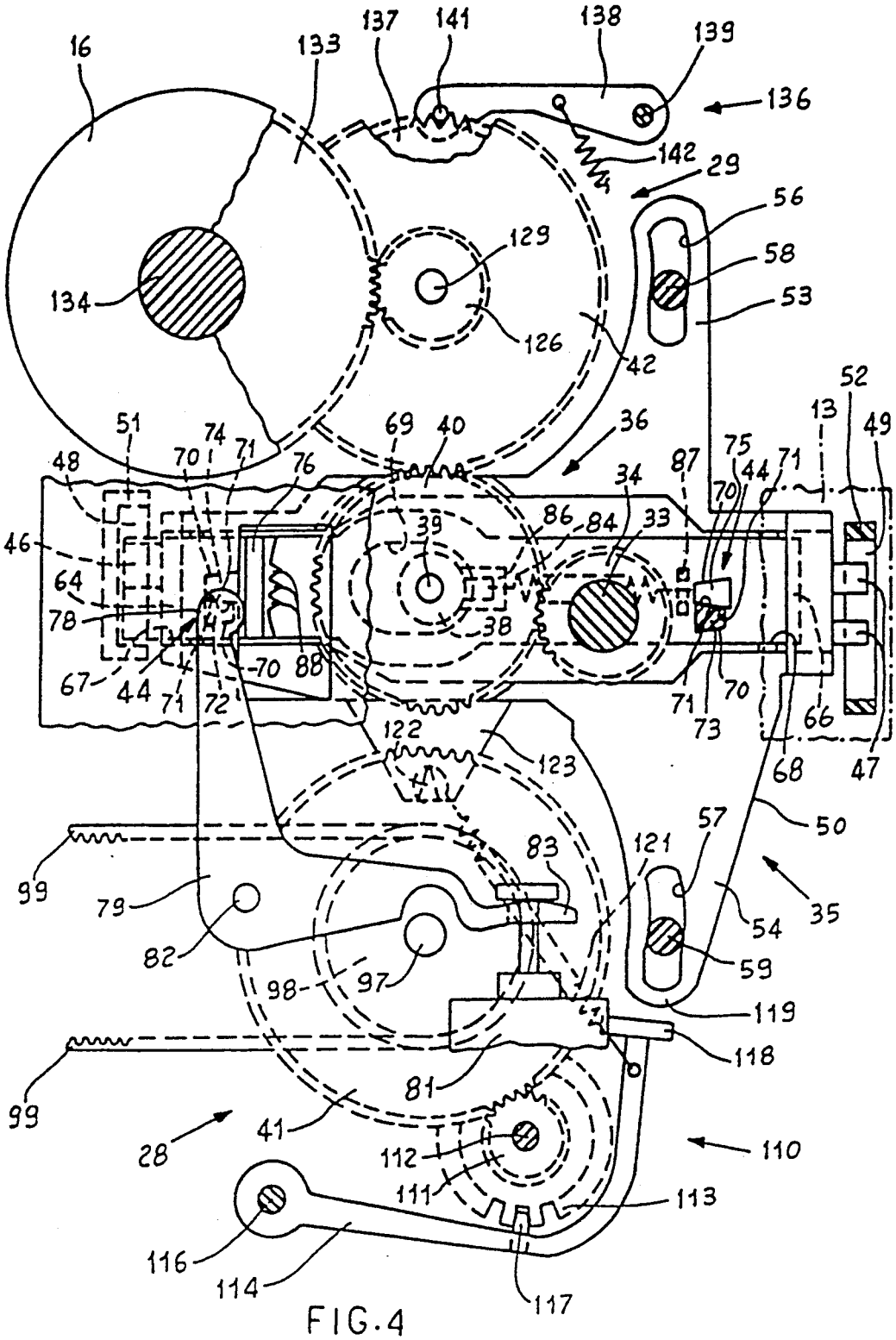
FIG. 4 shows a partial front view of the details in FIG. 2 in a second working position.
Figure 6:
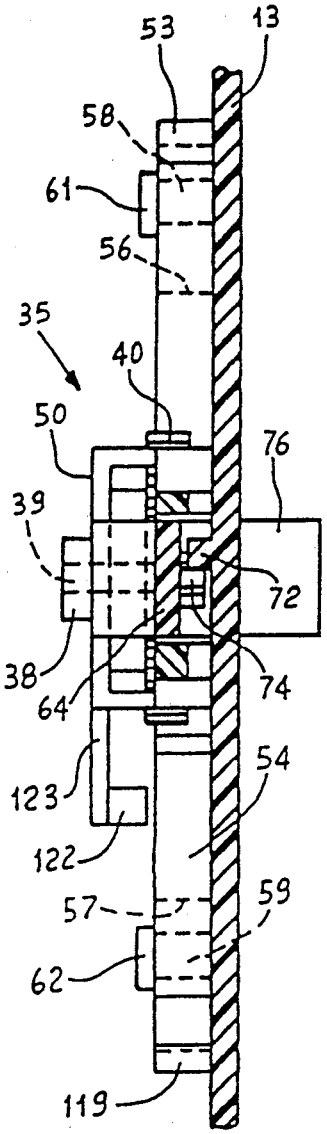
FIG. 6 is a partial sectional side view of some details shown in FIG. 5.
Figure 5:
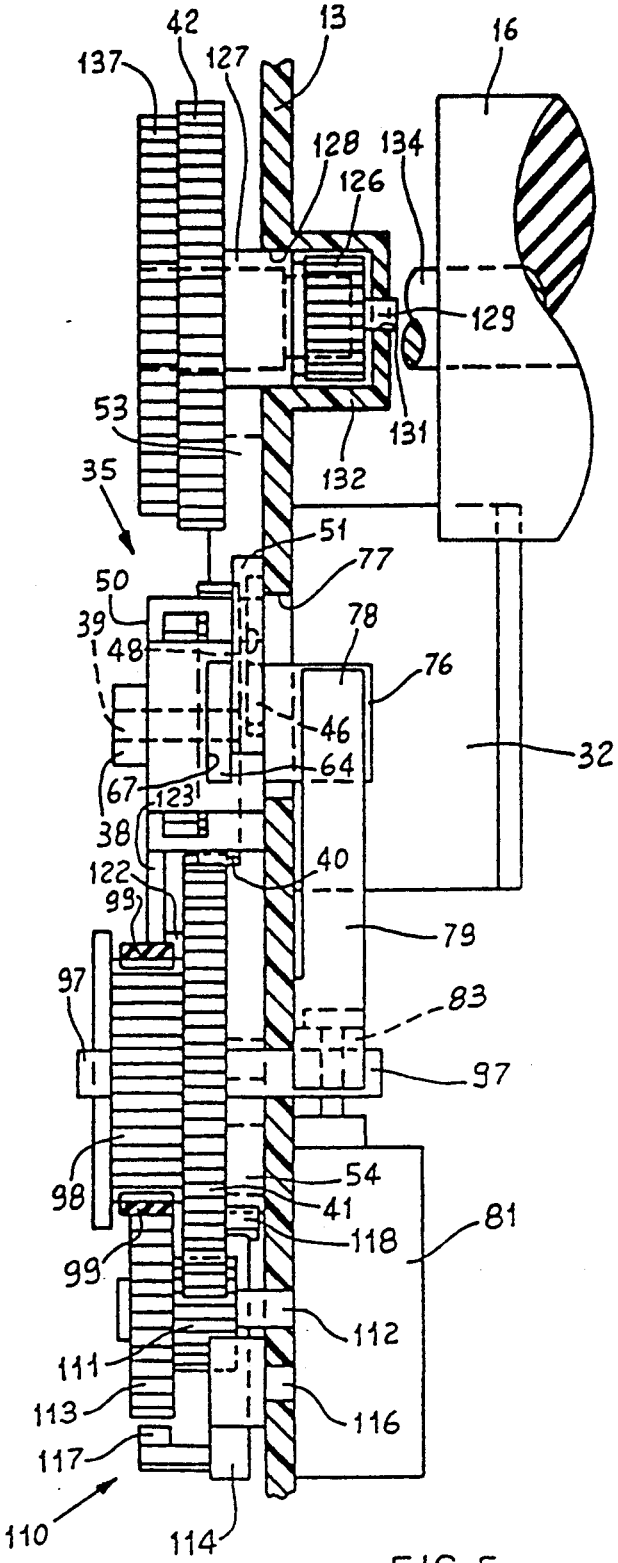
FIG. 5 is a partial side view of the details shown in FIG. 2.

The electronic control means 22 (see FIG. 10) comprises a CPU 91 having microprocessors, which is connected to the keyboard 21, ROMs 92 and RAMs 93. The electronic control means 22 comprises a program in the ROMs 92 which suitably controls the stepping motor 32 for rotation of the drive pinion 34 in one direction or the other by a predetermined amount such as to position the slider 50 in the first operative position as shown in FIG. 2 or in the second operative position as shown in FIG. 4. The control means 22 also controls various functions of the machine by means of an actuator circuit 94 for actuating the selection device 26 and the ribbon feed mechanism 27, by means of an actuator circuit 95 for actuating the striker solenoid 31 and the shift electromagnet 81, and by means of an actuator circuit 96 for actuating the stepping motor 32, as is required to produce the controlled movement of the slider 50 and to perform the functions associated with the transport device 28 and the line spacing device 29.

The transport device 28 (see FIGS. 1, 2, 3, 4, 5 and 9) receives the motion from the toothed wheel 41 which is rotatable on a pin 97 on the left-hand support 13 and comprises a toothed drive pulley 98 which is fixed with respect to the toothed wheel 41 and a toothed belt 99. The toothed belt 99 passes around and receives motion from the toothed pulley 98, it is guided around two direction-changing pulleys 100 and 101 rotatable on pins 102 and 103 on the left-hand support 13 and two direction-changing pulleys 104 and 105 rotatable on pins 106 and 107 on fixing elements 108 and 109 on the right-hand support 14, and it is fixed to the carriage 19 to displace the carriage on the guides 17 and 18 along the platen roller 16. The direction-changing pulleys 100, 101, 104 and 105 are idle pulleys and in addition the pulley 104 is adjustable by means of the eccentric pin 106 with a belt-tensioning function in per se known manner which is not described herein and not shown in the drawings.

The direction-changing pulleys 100, 101, 104 and 105 have their axes disposed in planes perpendicular to the axes of the pulley 98 and the roller 16 and the toothed belt 99 experiences a longitudinal turn through 90° between the pulley 98 and the two pulleys 100 and 101. In particular the toothed drive pulley 98 holds two runs of the toothed belt 99 parallel to a horizontal plane while the first direction-changing pulley 100 turns the upper part of the toothed belt 99 through 90° in the clockwise direction, then positioning it in a vertical plane and holding it parallel to the platen roller 16, towards the second direction-changing pulley 104. The direction-changing pulleys 104 and 105 guide the toothed belt 99 in a vertical plane parallel to the platen roller 16 towards the fourth direction-changing pulley 101. Finally the fourth pulley 101 turns the toothed belt 99 through 90° in an anti-clockwise direction, into a horizontal plane, guiding it towards the lower part of the drive pulley 98. The carriage 19 is fixed to the toothed belt 99 in the portion between the first direction-changing pulley 100 and the second direction-changing pulley 104 and is engaged to be moved along the platen roller 16 in per se known manner.

A positioning device indicated at 110 (see FIGS. 2, 3, 4, 5 and 9) co-operates with the toothed wheel 41 to hold the toothed belt 99 and thus the carriage 19 stationary when the slider 50 is in the second operative position. The positioning device 110 comprises a toothed sprocket 111 which is rotatable on a pin 112 of the left-hand support 13 and always engaged with the toothed wheel 41 of the transport device 28. The sprocket 111 is fixed with respect to a toothed wheel 113 co-operable with a positioning lever 114. The positioning lever 114 is rotatable on a pin 116 on the left-hand support 13 and comprises a tooth 117 capable of engaging with the toothed wheel 113 and a lug 118 co-operable with the end 119 of the arm 54 of the slider 50.

A spring 121 which is operatively disposed between a hook 122 on an arm 123 of the slider 50 and the positioning lever 114 holds the lug 118 against the end 119 of the arm 54 when the slider 50 is in the first operative position. As the slider 50 is positioned in the second operative position, the spring 121 causes the positioning lever 114 to rotate in the anti-clockwise direction, bringing the tooth 117 into engagement with the toothed wheel 113, thus preventing rotary movement of the toothed wheel 41. The transmission ratio between the wheel 41, the sprocket 111 and the number of teeth on the toothed wheel 113 are such that corresponding to an angular displacement by one tooth of the wheel 113 is the displacement of the carriage 19 by an elementary step, to stop the carriage in each of the printing positions corresponding to the pitches 1/10", 1/12", and 1/15".

The line spacing device 29 (FIGS. 1, 2, 3, 4 and 5) receives the motion from the toothed wheel 42 and comprises a pinion 126 connected to the toothed wheel 42 by means of a sleeve 127, which are fixed with respect to each other. The toothed wheel 42 and the pinion 126 are rotatably supported by the left-hand support 13 by means of the sleeve 127 which is accommodated in a mounting 128 and by means of a shaft 129 which projects from the pinion 126 and is accommodated in a mounting 131 of a flange 132 of the support 13. The pinion 126 is always engaged with a toothed wheel 133 fixed to a shaft 134 of the platen roller 16 and by means of which the platen roller 16 is rotatably supported by the supports 13 and 14.

A positioning device indicated at 136 co-operates with a toothed wheel 137 which is fixed with respect to the toothed wheel 42 to hold the platen roller 16 stationary when the slider 50 is in the first operative position. For that purpose the positioning device 136 comprises a lever 138 which is rotatable on a pin 139 on the left-hand support $1_3$ and comprises a cylinder member 141 co-operable with the teeth of the toothed wheel 137, under the force of a spring 142. In an alternative configuration which is not shown in the drawings the positioning device 136 may act on the periphery of a disc which is friction-coupled to the side of the toothed wheel 42 and interposed between the wheel 42 and the left-hand support 13.

The mode of operation of the transport device 28 and the selection device 29 is as follows, assuming that the rest position corresponds to that shown in FIG. 2 in which the slider 50 is in the first operative position, the slide member 43 is in the rest position due to the force of the spring 84 and the shift electromagnet 81 is deenergized. In that condition the motor 32 is held in the position achieved by a suitable holding current in its winding, the gear member 40 is engaged with the toothed wheel 41 for possible actuation of the transport device 28 while the line spacing device 29 is not motorizable and the platen roller 16 is held in an arrested condition by the positioning device 136.

In a situation in which the carriage 19 is to be moved along the platen roller 16, suitable actuation of some keys of the keyboard 21 generates a code for activation of the transport device 28. Since the device 28 is already actuable, the microprocessor 91 consequently passes a series of pulses to the actuator 96 to switch the current into the windings of the stepping motor 32 which rotate the drive shaft 33 in one direction or the other through an angular value corresponding to the code received. The drive pinion 34 rotates the gear member 40, the toothed wheel 41 and the toothed drive pulley 98$_{which}$ thus moves the toothed belt 99, displacing the carriage 19 in the forward or reverse direction by the number of steps corresponding to the code received from the keyboard 21.

Figure 3:
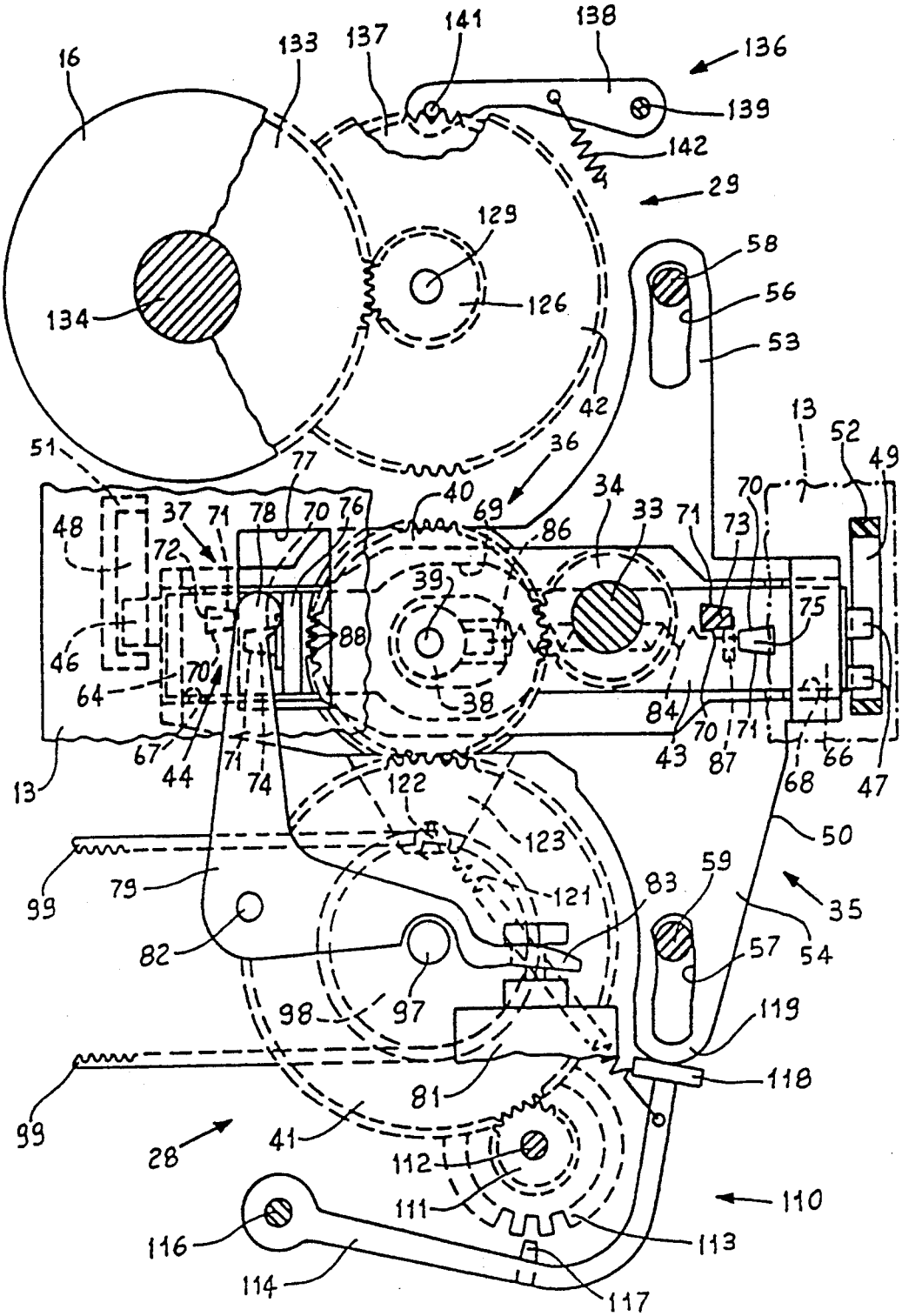
FIG. 3 is a partial front view of the details shown in FIG. 2 in a selection position.

If however the platen roller 16 is to be rotated, actuation of the keyboard 21 generates a code for first selecting and then activating the line spacing device 29. The microprocessor 91, by means of the actuator 95, therefore begins to pass an excitation current to the shift electromagnet 81, causing the bellcrank lever 79 to rotate in the clockwise direction. The end 78 of the lever 79, by means of the tongue 76, displaces the slide member 43 from the rest position to the selection position against the force of the spring 84, bringing the three teeth 88 into engagement with the gear member 40 and causing the shoulders 74 and 75 to disengage from the respective stops 72 and 73, as shown in FIG. 3. The consequence of that is that the toothed wheel 40 remains locked with respect to the slider 50 while the slider 50 is now free to move towards its second operative position.

Then, by means of the actuator 96, the microprocessor 91 activates the stepping motor 32 for rotary movement in the clockwise direction of the drive pinion 34 by a predetermined amount "S". The gear member 40 being locked, it is compelled to move together with the slider 50 along the path of motion imposed by the pins 58 and 59 and the slots 56 and 57. The rotary movement "S" is that required to position the slider 50 from the first operative position to the second operative position in which the gear member 40 is engaged with the toothed wheel 42 of the line spacing device 29, as can be seen from FIG. 4.

The microprocessor 91 subsequently deenergizes the shift electromagnet 81, the spring 84 rapidly moves the slide member 43 from the selection position to the rest position, causing the teeth 88 to disengage from the gear member 40 and the shoulders 74 and 75 to engage the stops 72 and 73 to hold the slider 50 in the second operative position. During the movement of the slider 50 from the first to the second operative position the spring 121 causes the lever 114 of the positioning device 110 to rotate in the anti-clockwise direction, bringing the tooth 117 into engagement with the toothed wheel 113, thereby locking the transport device 28.

The microprocessor 91 now passes a series of pulses to the actuator 96 for the stepping motor 32 which rotates the driveshaft 33 by a number of steps corresponding to the code received. The drive pinion 34 rotates the gear member 40, the toothed wheel 42, the pinion 126 and the toothed wheel 133, rotating with the platen roller 16 by the set line spacing value.

If after a certain period of time, for example 0.2 second, the electronic control means 22 does not receive from the keyboard 21 any code for activation of the line spacing device 29 or receives from the keyboard 21 a code for activation of the transport device 28, it again passes an excitation current to the shift electromagnet 81. The electromagnet 81 causes clockwise rotation of the bellcrank lever 79 to move the slide member 43 from the rest position to the selection position shown in FIG. 3. In that condition the toothed wheel 40 returns to being locked with respect to the slider 50 while the slider 50 is free to return to its first operative position. The holding current in the windings of the motor 32 prevents the spring 121 being able directly to cause return movement of the slider 50 to its first operative position.

Finally the electronic control means 22 activates the stepping motor 32 for anti-clockwise rotary movement of the drive pinion 34 by the amount "S" and the gear member 40, being locked by the teeth 88, returns the slider 50 to its first operative position. Finally the microprocessor 91 deenergizes the shift electromagnet 81 whereby the spring 84 returns the slide member 43 from the selection position to the rest position in which the shoulders 74 and 75 return to engage the stops 72 and 73 to hold the slider 50 in the first operative position, as shown in FIG. 2. During the movement of the slider 50 from the second to the first operative position, the end 119 of the arm 54 engages with the lug 118, causing clockwise rotary movement of the lever 114 of the positioning device 110, disengaging the tooth 117 from the toothed wheel 113 against the force of the spring 121.

The electronic typewriter 11 is now in the position shown in FIG. 2 with the transport and line spacing devices 28 and 29 respectively, for a subsequent operating cycle of the electronic control means 22 comprising for example actuation of one or other of two devices 28 and 29 as described above in accordance with the code that it receives from the keyboard 21.

It will be appreciated that the electronic typewriter, the various devices and mechanisms and the sequence of their modes of operation as described above may be the subject of various modifications and improvements both in regard to the form and the arrangement of the parts without thereby departing from the scope of the present invention.

In particular in a first alternative embodiment for the return movement of the slider 50 to its first operative position the microprocessor 91, after excitation of the electromagnet 81, and by means of the actuating circuit 96, deactivates the windings of the stepping motor 32 and the return movement of the slider 50 takes place by means of the spring 121, causing forced rotary movement of the driveshaft 33.

In a second alternative embodiment the positioning means 44 which removably hold the slider 50 in the first and second operative positions can be replaced by a bistable spring such as to hold the slider 50 in the first and second operative positions. When the slide member 43 is in the selection position the electronic control means 22 will be able to activate the stepping motor 32 for a rotary movement of the drive pinion 34 by the amount "S" in the clockwise or anti-clockwise direction while the gear member 40 is locked. As the drive pinion 34 initiates the rotary movement, the bistable spring applies a contrary force to the movement in progress until it moves beyond its dead center point and thus facilitates that movement, subsequently holding the slider 50 in the operative position attained.

In a third alternative construction, with positioning of the slider 50 being effected by a bistable spring, the microprocessor 91 activates the motor 32 for a rotary movement of the pinion 34 of less than the amount "S" but more than that required to go beyond the dead center point of the bistable spring. The motor 32 is then deactivated and final positioning of the slider 50 is effected mechanically directly by the bistable spring.

A fourth embodiment does not have any stop element 88 for the wheel 40. The thrust member may comprise a rack on the slide member 43, which is brought into engagement with the gear 40 by the operation of the shift electromagnet 81 and the actuating element 79. The slots 56 and 57 are rectilinear and in this case also the electronic control means 22 suitably activates the stepping motor 32 for rotary movement of the drive pinion 34 by a fixed amount in one direction or the other according to the operative position of the slider 50. The drive pinion 34 rotates the gear 40 but at the same time by means of the rack it can displace the slider 50, positioning it in one of the two operative positions thereof.

The shift member with servomechanism, as described above, may finally also be applied to functions of the typewriter which are different from the transport device or the line spacing device or both, comprising for example the character selection devices and/or the typing and/or correction ribbon functions.

We claim:

1. An electronic typewriter comprising:

an electric motor having a driveshaft which is rotatable in both directions;

a first function device;

a second function device;

a shift member displaceable from one of two operative positions to the other for connecting the first or the second function device to the driveshaft;

a shift electromagnet for control of said shift member;

an electronic control means for controlling the electric motor and the shift electromagnet;

a servomechanism for displacing the shift member between the two operative positions and activatable to be motorized by said driveshaft;

an actuating element operated by the shift electromagnet to actuate said servomechanism; and positioning means for holding said shift member in each of the two operative positions and wherein the electronic control means selectively controls said motor to displace the shift member from one of said operative positions to the other by means of said servomechanism.

2. An electronic typewriter according to claim 1, in which said servomechanism comprises a thrust member controlled by said actuating element between a rest state and an operative state and in which said thrust member in the operative state is capable of motorization from the driveshaft to produce a thrust action between the two operative positions in response to a rotary movement of said driveshaft.

3. An electronic typewriter according to claim 1, including an intermediate gear member carried rotatably by said shift member and permanently rotatably connected to said driveshaft, wherein said intermediate gear member is capable of motorizing the transport device and the line spacing device, respectively, in a first position and in a second position of the two operative positions of said shift member.

4. An electronic typewriter according to claim 3, in which the first function device comprises a line spacing device for rotating a platen roller and the second function device comprises a transport device for moving a printing carriage in front of the platen roller in both directions, and including a base frame structure having a support capable of rotatably supporting a toothed wheel of the transport device and a toothed wheel of the line spacing device, and in which the shift member is supported by said support, the servomechanism is supported by said shift member, and said driveshaft comprises a drive pinion which is always engaged with said intermediate gear member which in turn is capable of engaging with the toothed wheel of the transport device when said shift member is in the first operative position and with the toothed wheel of the line spacing device when said shift member is in the second operative position.

5. An electronic typewriter according to claim 4, in which said shift member comprises a slider having slots capable of accommodating fixed pins for guiding the slider in its movement between the two operative positions along a path of motion such as to hold said intermediate gear member always engaged with said drive pinion.

6. An electronic typewriter according to claim 2, in which the thrust member of said servomechanism comprises a stop element operated by the actuating element to lock said intermediate gear member with respect to the shift member in said operative state and guide means for said shift member for converting the rotary movement of the driveshaft into a displacement of said shift member when said intermediate gear member is locked by said stop element.

7. An electronic typewriter according to claim 5, in which the thrust member of said servomechanism comprises a stop element operated by the actuating element to lock said intermediate gear member with respect to the shift member in said operative state and guide means for said shift member for converting the rotary movement of the driveshaft into a displacement of said shift member when said intermediate gear member is locked by said stop element.

8. An electronic typewriter according to claim 7, in which said stop element comprises one or more teeth carried by a slide member accommodated and guided in two seats of said slider, said slide member is capable of alternating rectilinear motion between a rest position and a selection position corresponding to the rest state and to the operative state of the thrust member under the force of the actuating element for release and locking of said intermediate gear member in a direction which is substantially perpendicular to the direction of movement of said slider.

9. An electronic typewriter according to claim 8, in which said gear member is rotatable by means of a shaft on a sleeve of said slider, and said slide member has a groove of a size such as to accommodate said shaft with play in the rest position and in the selection position.

10. An electronic typewriter according to claim 8, in which said tooth or said teeth are capable of engaging with said intermediate gear member when the slide member is in the selection position to block rotary movement of said gear member and convert the rotary movement of the drive pinion into displacement of said slider and wherein the electronic control means activates said motor for rotary movement of the drive pinion in one direction or the other by a predetermined amount such as to position the slider in the first and the second operative positions.

11. An electronic typewriter according to claim 1, in which said positioning means comprise first and second stop means which are controlled by said actuating element and which are capable of selectively arresting said shift member in each of the two operative positions.

12. An electronic typewriter according to claim 11, in which said first and second stop means each comprise one or more stop surfaces and one or more cooperating surfaces supported by said shift member to move under the force of the actuating element in a direction of motion having a component perpendicular to the direction of motion of the shift member between said two operative positions.

13. An electronic typewriter according to claim 8, including a first and second stop means each of which comprise one or more stop surfaces and one or more cooperating surfaces supported by said shift member to move under the force of the actuating element in a direction of motion having a component perpendicular to the direction of motion of the shift member between said two operative positions.

14. An electronic typewriter according to claim 10, including a first and second stop means each of which comprise one or more stop surfaces and one or more cooperating surfaces supported by said shift member to move under the force of the actuating element in a direction of motion having a component perpendicular to the direction of motion of the shift member between said two operative positions.

15. An electronic typewriter according to claim 13, in which the stop surfaces comprise two stops which are fixed with respect to said support and the cooperating surfaces comprise two shoulders which are fixed with respect to said slide member, and said stops and said shoulders are in the form of wedges having the opposite sides of greater length convergent relative to each other and formed by inclined surfaces which define the stop surfaces and the cooperating surfaces of the first and second stop means, and in which said two shoulders are positioned with their inclined surfaces opposite to the inclined surfaces of the two stops in such a manner as to cooperate with each other when the slider is respectively in the first and the second operative positions.

16. An electronic typewriter according to claim 15, in which the two stops and the two shoulders cooperate with each other when said slide member is in the rest position but are disengaged from each other when said slide member is in the selection position.

17. An electronic typewriter according to claim 15, in which said slide member has its ends accommodated in the two seats of said slider which guide it in its alternating rectilinear movement, said two shoulders are positioned adjacent to said ends, said tooth or said teeth are positioned adjacent to one of said ends, said slide member comprises a tongue positioned between one of said two shoulders and said one or more teeth which projects beyond the free edge of said shoulder to cooperate with said actuating element which is actuated by said shift electromagnet to move said slide member from said rest position to said selection position, and resilient means move said slide member from said selection position to said rest position.

18. An electronic typewriter according to claim 17, in which said electronic control means, by means of an actuator, passes an excitation current to the shift electromagnet to cause rotation of the actuating element to move the slide member from the rest position to the selection position in which the tooth or teeth are engaged with the gear member, actuates the electric motor for rotating the driveshaft with the drive pinion in one direction or the other by said predetermined amount to position the slider either in the first or in the second operative position, and deenergizes the shift electromagnet and the resilient means return the slide member to the rest position, whereby the gear member is engaged either with the toothed wheel of the transport device or with the toothed wheel of the line spacing device.

19. An electronic typewriter according to claim 17, in which said tongue is of a dimension such as to co-operate with said actuating element both when the slider is in the first operative position and in the second operative position, and said resilient means comprise a spring operatively disposed between said slider and said slide member.

20. An electronic typewriter according to claim 4, in which said support is substantially perpendicular to the platen roller and the toothed wheel of the transport device is parallel to said support and in which the transport device comprises a toothed drive pulley which is parallel to the support and around which is passed a toothed belt and a series of direction-changing pulleys which guide the toothed belt from a plane parallel to the support to a plane perpendicular to the support along the platen roller.

21. An electronic typewriter according to claim 20 in which the base frame structure comprises said support being a first support positioned on one side and a second support positioned on the opposite side, said toothed drive pulley is fixed with respect to the toothed wheel and holds the toothed belt parallel in a horizontal plane to said first support and in which said series of direction-changing pulleys comprises a first pulley supported by said first support and around which the toothed belt is rotated through 90° to be positioned in a vertical plane parallel to the platen roller, a second pulley supported by the second support which guides the toothed belt still holding it in the vertical plane perpendicular to the platen roller, a third pulley supported by the second support which guides the toothed belt holding it in the vertical plane parallel to the platen roller, and a fourth pulley supported by said first support rotates the toothed belt through 90° in the opposite direction, positioning it in a horizontal plane to guide it and engage it with said toothed drive pulley.

22. An electronic typewriter according to claim 1, including a positioning mechanism capable of selectively cooperating with means of the second function device for holding the second function device locked when said shift member is in the operative position for connection of the driveshaft to the first function device.

23. An electronic typewriter according to claim 4, including a positioning mechanism capable of selectively cooperating with means of the second function device for holding the second function device locked when said shift member is in the operative position for connection of the driveshaft to the first function device.

24. An electronic typewriter according to claim 23, in which said positioning mechanism comprises a toothed sprocket engaged with said toothed wheel of said transport device, a toothed wheel which is fixed with respect to said sprocket, a positioning lever movable from a rest position to a working position in which it is engaged by means of a tooth with the toothed wheel, and resilient means for positioning said positioning lever in the working position.

25. An electronic typewriter according to claim 24, in which when said shift member is in the first operative position it holds said positioning lever in the rest position against the force of said resilient means and wherein said resilient means position said positioning lever in the working position when said shift member is in the second operative position.

26. An electronic typewriter according to claim 4, in which said support is substantially perpendicular to the platen roller and the toothed wheel of the line spacing device is parallel to said support, and in which the line spacing device comprises a pinion which is fixed with respect to said toothed wheel of the line spacing device which is always engaged with a toothed wheel which is fixed with respect to the platen roller.

27. An electronic typewriter according to claim 26, in which the toothed wheel of the line spacing device is fixed with respect to a toothed wheel which is positioned opposite to said pinion and is capable of cooperating with a positioning element for holding said line spacing device locked when said shift member is in the first operative position.

28. An electronic typewriter comprising:

a device for a first function having a motion drive for the first function;

a device for a second function having a motion drive for the second function;

a single motor member for the two motion drives;

a shift member displaceable in a shift direction between a position for the first function and a position for the second function to impart the single motor member's motion to the motion drive for the first function and to the motion drive for the second function, respectively;

a shift electromagnet and an electronic unit for control of said electromagnet;

an intermediate member supported by the shift member to be movable in a selection direction having a component perpendicular to the shift direction and a thrust member actuated by said shift member and capable of providing a thrust action in said shift direction, and in which:

said intermediate member is connected to said electromagnet to be displaced in the selection direction from a disengagement position to an engagement position in which it cooperates with said thrust member;

said intermediate member is capable of being displaced together with said shift member in the shift direction by means of the thrust member;

means are provided for holding the shift member in position selectively in said position for the first function and in said position for the second function in the disengaged position of the intermediate member; and said electronic unit controls said motor member to actuate displacement of the shift member from one of the positions for the first function and for the second function to the other.

29. An electronic typewriter according to claim 28, in which the intermediate member is carried rotatably by said shift member and is permanently rotatably connected to said single motor member, the thrust member comprises a stop element which is actuated by the shift member to lock said intermediate member with respect to the shift member in said engagement position, and guide means for said shift member for converting the rotary movement of the single motor member into a displacement of said shift member when said intermediate member is locked by said stop element.

30. An electronic typewriter according to claim 29, including a base frame structure having a support wherein the shift member is supported by said support, and in which said intermediate member comprises a gear member and said single motor member comprises a drive pinion which is always engaged with said intermediate gear member, said shift member comprises a slider having slots capable of accommodating fixed pins of said support for guiding the slider in its movement between the position for the first function and the position for the second function along a path of movement such as to hold said intermediate gear member always engaged with said drive pinion.

31. An electronic typewriter according to claim 30, in which said means for holding said slider in position comprise first and second stop means controlled by said thrust member and capable of selectively arresting said slider in each of the two positions, said first and said second stop means each comprise one or more stop surfaces and one or more cooperating surfaces supported by said slider to move under the action of the shift electromagnet in a direction of motion having a component perpendicular to the direction of motion of the slider between said two positions for the first function and for the second function.

32. An electronic typewriter according to claim 30, in which the device for the first function comprises a line spacing device including a toothed wheel and the device for the second function comprises a transport device including a toothed wheel, and said intermediate gear member is capable of engaging with a toothed wheel of the line spacing device when said slider is in a first operative position and with a toothed wheel of the transport device when said slider is in a second operative position.

33. An electronic typewriter comprising an electric motor having a driveshaft which is rotatable in both directions, a first function device, a second function device, a shift member displaceable from one of two operative positions to the other for connecting the first or the second function device to the driveshaft, a shift electromagnet for control of said shift member, and an electronic control means for controlling the electric motor and the shift electromagnet, the improvement comprising:

a servomechanism for displacing the shift member between the two operative positions and activatable to be motorized by said driveshaft;

an actuating element operated by the shift electromagnet to actuate said servomechanism; and positioning means for holding said shift member in each of the two operative positions and wherein the electronic control means selectively controls said motor to displace the shift member from one of said operative positions to the other by means of said servomechanism.

* * * * *